US005845780A

United States Patent [19]

Allen

[11] Patent Number: 5,845,780

[45] Date of Patent: Dec. 8, 1998

[54] ATHLETIC BAG

[76] Inventor: Vickey L. Allen, 4009 Gertrude, Dearborn Heights, Mich. 48125

[21] Appl. No.: 881,889

[22] Filed: Jun. 24, 1997

[51] Int. Cl.[6] ..... A45C 3/00

[52] U.S. Cl. ..... 206/579; 190/110; 206/315.1

[58] Field of Search ..... 206/315.1, 579, 206/747–750; 150/113; 190/110

[56] References Cited

U.S. PATENT DOCUMENTS

| | | | |
|---|---|---|---|
| 2,321,807 | 6/1943 | Glickman | 206/579 |
| 2,587,559 | 2/1952 | Wetherbee | 206/579 |
| 3,232,397 | 2/1966 | McCoy | 190/110 |
| 4,182,391 | 1/1980 | Kjose . | |
| 4,263,951 | 4/1981 | Siegel | 150/113 |
| 4,386,642 | 6/1983 | Durbin | 190/110 |
| 4,509,769 | 4/1985 | Franco et al. | 190/110 |
| 4,804,084 | 2/1989 | Markovich . | |
| 4,951,816 | 8/1990 | Smith . | |
| 5,096,030 | 3/1992 | Espinosa et al. | 190/110 |
| 5,356,000 | 10/1994 | Scicluna . | |
| 5,356,002 | 10/1994 | Brown . | |
| 5,356,004 | 10/1994 | Weinreb | 150/113 |
| 5,447,216 | 9/1995 | Freyvogel | 206/315.1 |
| 5,642,809 | 7/1997 | Mayville | 206/315.1 |
| 5,680,914 | 10/1997 | Reiser | 190/110 |

*Primary Examiner*—Jim Foster

*Attorney, Agent, or Firm*—Harness, Dickey & Pierce, P.L.C.

[57] ABSTRACT

The present invention provides an athletic bag for conveniently carrying, storing and airing out athletic equipment. To accomplish this, the bag is positionable between an open mode preventing access to an interior volume thereof and an open mode permitting access to the interior volume. In the open mode, the bag is orientable to an upright position such that it may stand unaided providing access to the interior of the bag in a locker-type fashion. Further, specialized compartments are provided for stowing the athletic equipment such that itemized pieces thereof are not commingled within the interior volume of the bag. Further, the bag may be hung for enhancing air circulation around the athletic equipment such that it quickly dries out. Advantageously, the panels to which the athletic equipment is secured are removably attached to the interior compartment of the athletic bag and therefore may be removed and hung separately to further enhance drying of the athletic equipment and to also facilitate laundering of the fabric enclosure.

18 Claims, 2 Drawing Sheets

ATHLETIC BAG

BACKGROUND OF THE INVENTION

1. Technical Field

The present invention generally relates to carrying and storage devices and, more particularly, to an athletic bag for universally carrying, storing, and airing out athletic equipment such as hockey pads, skates and gloves.

2. Discussion

Athletes commonly use bags for transporting equipment necessary for participation in a specific sport to and from athletic arenas. Often, these bags are designed for general purpose use and simply consist of a large central compartment for stowing the equipment in a random and commingled fashion. Also, these bags commonly employ a fabric enclosure which leads to the bag collapsing on itself and the equipment therein.

Upon concluding a sporting event, an athlete typically removes the required equipment and places it in the bag. The equipment is then transported to a storage area such as a locker room, closet, or basement. At this location, the bag contents must be unpacked and hung in order to properly air out and/or dry. This task is often tedious and time consuming.

Therefore, it is desirable to provide an athletic bag having storage compartments specifically shaped for stowing particular pieces of equipment to prevent commingling of the equipment within the bag.

It would also be desirable to provide an athletic bag having a rigid structure such that the bag may stand in an upright orientation such that the equipment stowed therein may be accessed in a locker-type fashion and may be aired out without removing it from the bag.

It would additionally be desirable to provide an athletic bag including removable panels secured to the interior of a fabric enclosure for supporting the equipment within the bag such that the panels may be removed from the enclosure and separately hung to facilitate drying and/or storing of the equipment and laundering of the fabric enclosure.

SUMMARY OF THE INVENTION

The above and other objects are provided by an athletic bag for conveniently carrying, storing, and airing out athletic equipment. The bag preferably includes a plurality of walls hingedly secured adjacent one another such that the walls are positionable between a closed mode preventing access to an interior volume of the walls and an open mode permitting access to the interior volume of the walls. In the open mode, the walls also enable the bag to stand in an upright orientation on an end to provide locker-type access to the interior of the bag. The bag also includes itemized storage members for stowing particular pieces of equipment within the bag such that the equipment is selectively prevented from commingling. In a more preferred embodiment of the present invention, a rigid panel is removably secured to at least one of the walls of the bag for providing rigidity to the bag such that it may stand upright and for enabling the equipment stored on the panels to be removed and stored as a unit.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed toward an athletic bag for conveniently carrying, storing and airing out athletic equipment. To accomplish this, the bag is positionable between an open mode preventing access to an interior volume thereof and an open mode permitting access to the interior volume. In the open mode, the bag is orientable to an upright position such that it may stand without additional support to provide access to the interior volume of the bag in a locker-type fashion and allow the equipment therein to dry without removal. Further, specialized compartments are provided for stowing the athletic equipment such that individual components of equipment are not commingled within the interior volume of the bag. Further, the bag may be hung for enhancing air circulation around the athletic equipment such that it quickly dries out. Advantageously, the panels to which the athletic equipment is secured are removably attached to the interior compartment of the athletic bag. Therefore, the panels may be removed and hung separately from the fabric enclosure of the bag to even further enhance drying of the athletic equipment and to also facilitate laundering of the fabric enclosure.

Figure 1:
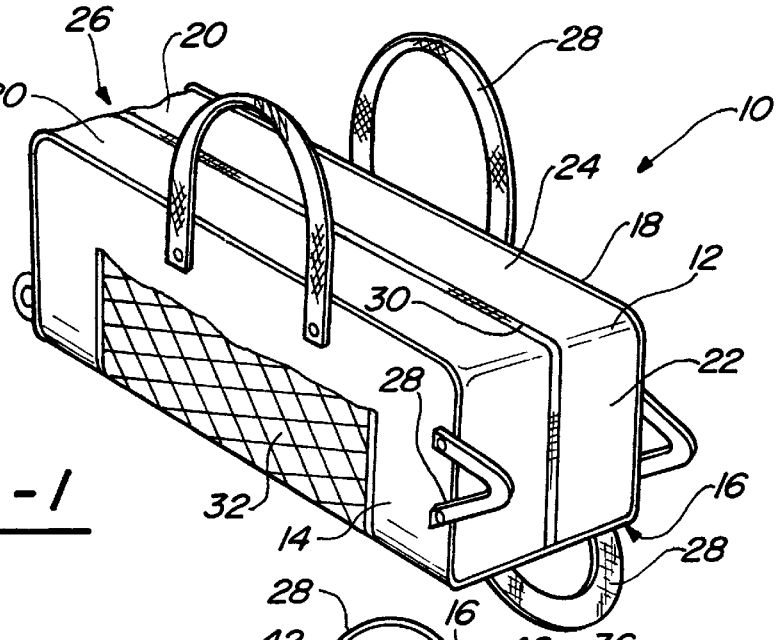
FIG. 1 is a front, top, and side perspective view of an athletic bag in a closed mode constructed in accordance with the present invention.

Referring now to the drawings, an athletic bag 10 constructed in accordance with the present invention is illustrated in FIG. 1. The athletic bag 10 includes a fabric enclosure 12 consisting of a first rectangularly shaped side wall 14, a rectangularly shaped back wall 16, and a rectangularly shaped second side wall 18. The side walls 14, 18 are hingedly secured to the back wall 16 for movement between an open mode and a closed mode. Preferably, this is accomplished by constructing the back 16 and side walls 14, 18 of a continuous fabric material.

A plurality of handle and loop members 28 are secured to the walls 14, 16, 18 for facilitating transportation and/or hanging of the athletic bag 10. The bag 10 also includes a pair of closure flaps 20 forming the top 22, front 24, and bottom 26 of the bag 10. Further, a pair of wheels 29 are provided along an edge of the bottom 26 of the bag 10 enabling the bag 10 to be transported by rolling. The closure flaps 20 are interengaged by way of a closure mechanism 30, preferably consisting of at least one zipper. As depicted in FIG. 1, storage compartments 32 may be secured to the exterior of the walls 14, 16, 18 for stowing additional equipment.

Figure 2:
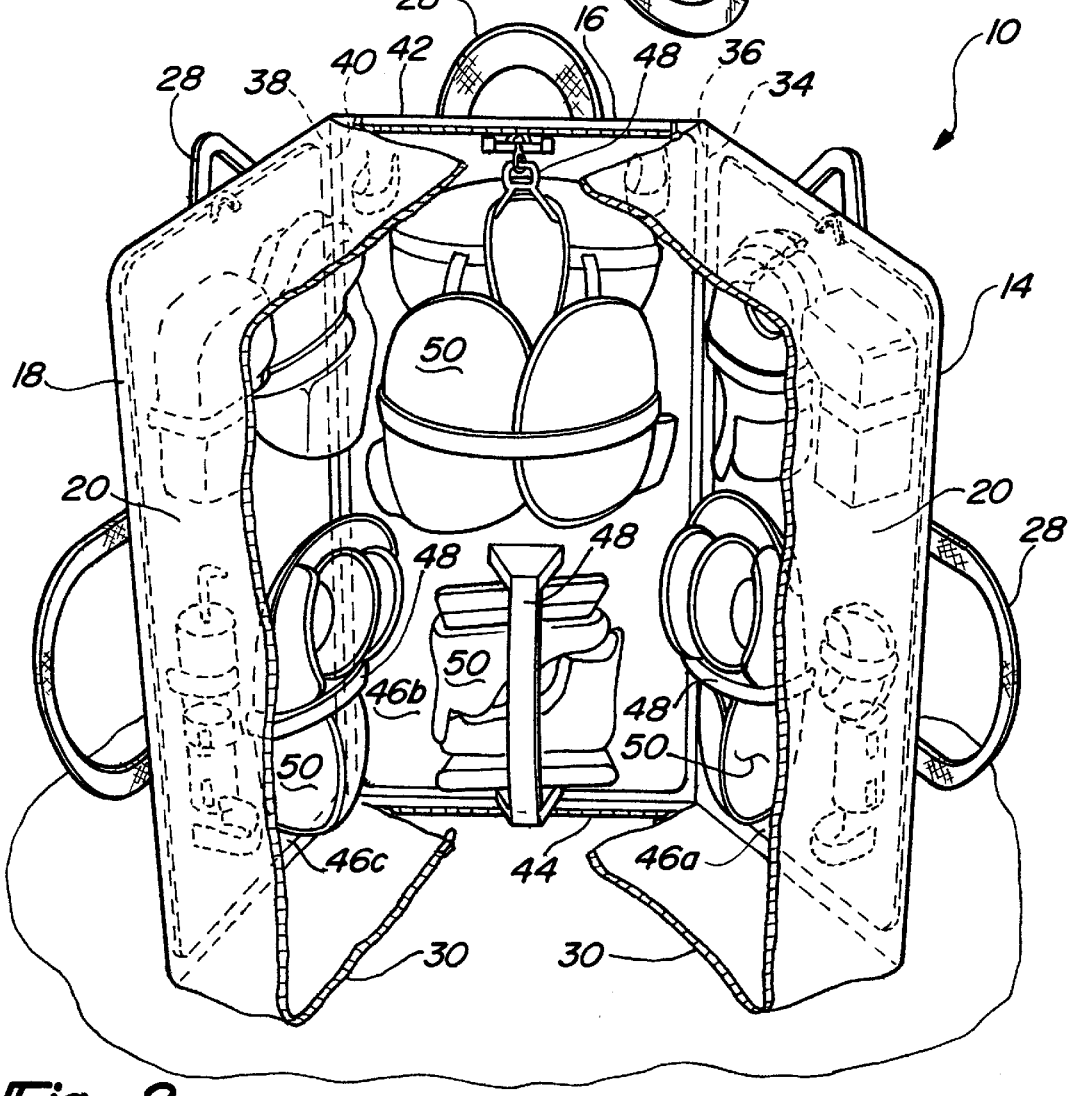
FIG. 2 is a front, top, and interior perspective view of an athletic bag in an open mode constructed in accordance with the present invention.

Turning now to FIG. 2, the athletic bag 10 is depicted in an open mode which is effectuated by releasing the closure mechanism 30 and folding out the side walls 14, 18 to spread the closure flaps 20 from one another. As can be seen, the first side wall 14 is hingedly secured along a first edge 34 to a first edge 36 of the back wall 16. Similarly, the second side wall 18 is hingedly secured along a first edge 38 to a second edge 40 of the back wall 16. Further, the top edge 42 and bottom edge 44 of the back wall 16 may be interconnected by way of the plurality of zippers 30 extending along a perimeter of the first and second closure flaps 20. As will be described in greater detail below, a plurality of rigid panels 46*a*–46*c* are removably secured to the interior of the back, first, and second side walls 14, 16, 18 of the fabric enclosure 12. A plurality of storage members 48 such as adjustable elastic straps, tie downs, hangers, and pockets are coupled to the panels for discretely storing athletic equipment 50 such as waterbottles, hockey pads, gloves and skates therein.

Figure 3:
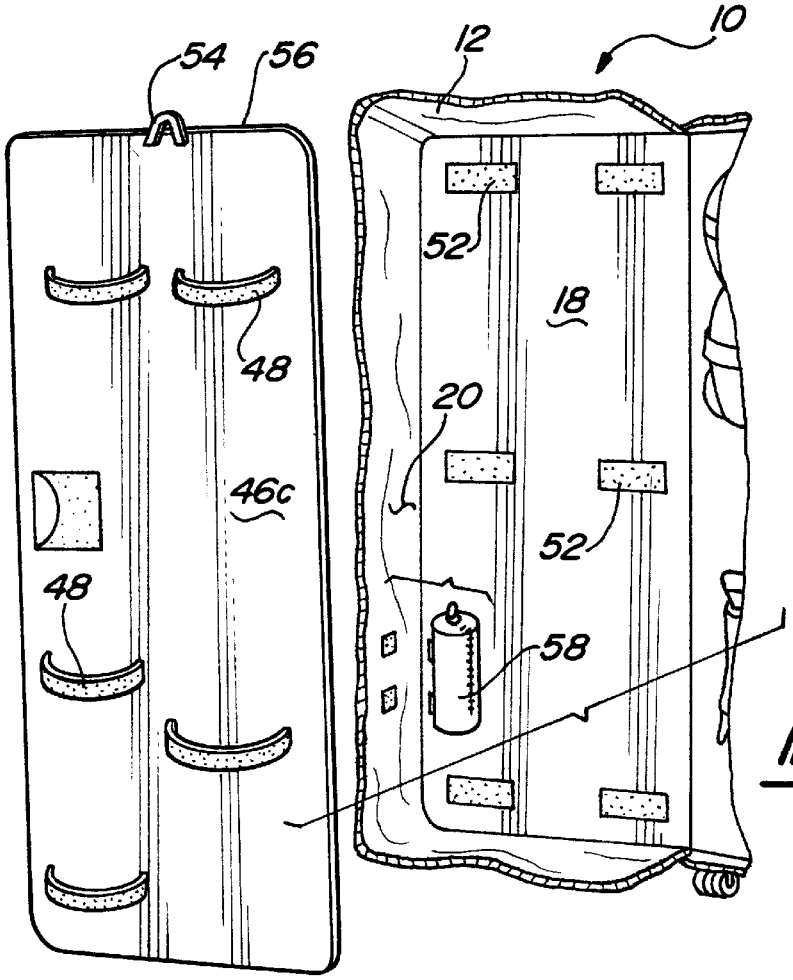
FIG. 3 is a perspective view illustrating a panel of the bag in a removed position from a side wall in accordance with the present invention.
Figure 4:
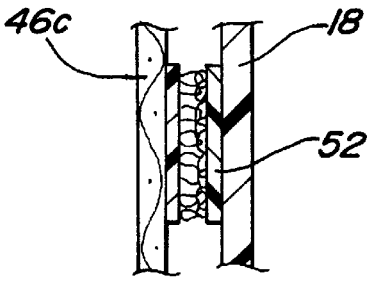
FIG. 4 is a cross sectional view of the locking mechanism for removably securing a panel to a wall of the athletic bag in accordance with the present invention.
Figure 5:
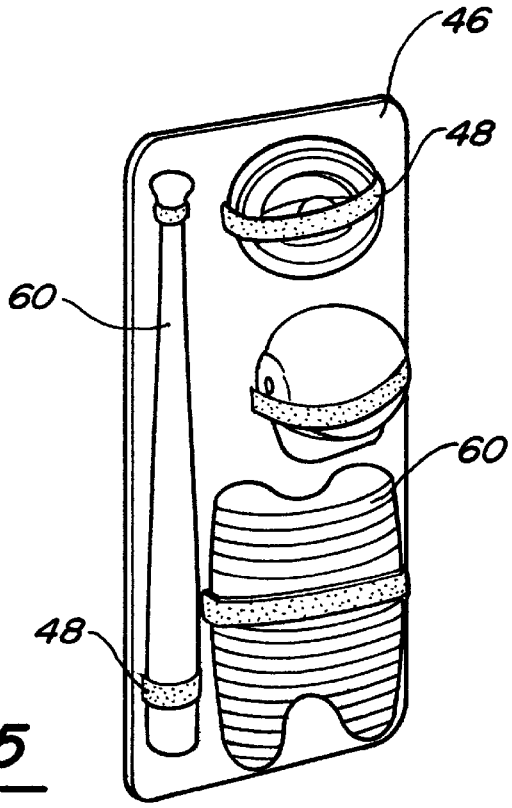
FIG. 5 is a perspective view of an alternate embodiment panel in accordance with the present invention.

Turning now to FIG. 3, the panels 46*a*–46*c* will now be described in greater detail. Although only the side panel 46*c* is illustrated, it will be appreciated that the panel 46*c* is merely representative of the panels 46*a*–46*c*and either could substitute therefore. The panel 46*c* is removably secured to the side wall 18 by way of a plurality of fastener members 52. As shown in FIG. 4, the fasteners 52 preferably comprise hook and loop type mechanisms such as velcro (™), however, other fasteners such as snaps, buttons, or zippers will suffice. The panel 46*c* also includes a suspension mechanism 54 coupled to a top edge 56 thereof for facilitating hanging of the panel 46*c* independently of the fabric enclosure 12. Additionally, a storage member 58 is illustrated affixed to the first closure flap 20 of the bag 10. As will be appreciated, the storage compartments 48 can be placed along the panels 20 or walls 14, 16, 18 of the enclosure 12 as desired to facilitate proper stowing of event specific equipment in the bag 10. For instance, the interior arrangement of the panels 46*a*–46*c* and storage members 48 may be manipulated to facilitate stowing of baseball equipment 60 as illustrated in FIG. 5.

In operation, the athletic bag 10 is positioned to an open mode and equipment 50 is selectively secure within the storage members 48. The bag 10 is then moved to a closed mode and the equipment 50 is transported to a storage area therein. Upon arriving at the storage area, the bag 10 is converted to an open mode by releasing the closure mechanism 30. Thereafter, the bag 10 may be positioned in an upright orientation by positioning it on the ends of the back, first and second side walls 14, 16, 18. In this orientation, air may circulate about the equipment 50. This eliminates the need for removing the equipment 50 from the interior volume of the bag 10. Alternatively, the bag 10 may be hung by the handle or loop members 28. In this position, the side walls 14, 18 may be opened wider relative to the back wall 16 than when oriented in an upright or locker-type fashion. A third option is to remove the panels 14, 16, 18 from the enclosure 12 and suspend them by the suspension mechanisms 54. This enables air to circulate about the equipment 50 on the panels 14, 16, 18 without interference with the enclosure 12. Further, the enclosure 12 may now easily be laundered.

Although the present invention has been described above with reference to a specific embodiment, it should be appreciated that various modifications may be made to the invention without avoiding its scope. For instance, the closure mechanism described herein as a zipper may be modified to include snaps, buttons, hook-and-loop fasteners or other means. Additionally, any number of means for coupling the panel to the fabric enclosure may be utilized to provide rigidity to the bag. For instance, a two-sided fabric wall having a pocket therein may be utilized whereby the panel is interposed within the pocket. Furthermore, the hook-and-loop fasteners for securing the panel to the walls may easily be replaced with snaps, buttons or the like.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. An athletic bag for conveniently carrying, storing, and airing out athletic equipment, said bag comprising:

a plurality of walls hingedly secured adjacent one another such that said walls are positionable between a closed mode preventing access to an interior volume of said walls and an open mode permitting access to said interior volume of said walls and enabling said bag to stand in an upright orientation on an end of said walls;

said walls including a back wall, a first side wall hingedly secured to said back wall and a second side wall hingedly secured to said back wall opposite said first side wall;

a back panel removably secured to said back wall;

a first side panel removaby secured to said first side wall;

a second side panel removably secured to said second side wall; and at least one storage member for stowing said equipment coupled to at least one of said back panel, first side panel and second side panel, said storage member selectively preventing commingling of said equipment in said interior volume of said walls.

2. The bag of claim 1 further comprising at least one panel secured to at least one of said walls for providing a degree of rigidity thereto.

3. The bag of claim 2 wherein said panel is removably secured to said wall such that said panel may be joined with said wall in each of said open and closed modes and may be detached and stored independently therefrom.

4. The bag of claim 1 further comprising a closure mechanism for interengaging said plurality of walls in said closed mode.

5. The bag of claim 1 further comprising suspension members coupled to at least one of said walls enabling said bag to be suspended therefrom.

6. The bag of claim 1 further comprising a handle member secured to at least one of said walls for facilitating transportation of said bag.

7. An athletic bag for universally carrying, storing and airing out athletic equipment comprising:

a substantially rigid back wall having a top edge, bottom edge and first and second side edges;

a substantially rigid first side wall pivotally secured to said first side edge of said back wall; and a substantially rigid second side wall pivotally secured to said second side edge of said back wall;

each of said walls including a rigid panel removably secured to a common fabric enclosure on a first side; and storage elements for holding said equipment coupled to said panels on a second side such that said equipment may be selectively prevented from commingling within said walls;

wherein said walls are moveable to a folded-out position for supporting said bag in a vertical orientation and permitting access to an interior volume thereof.

8. The bag of claim 7 wherein said walls further comprise at least one rigid panel removably secured to a fabric enclosure.

9. The bag of claim 7 further comprising a closure mechanism for interconnecting said top and bottom edges of said back wall and said first and second side walls.

10. The bag of claim 7 further comprising hanging members coupled to said walls for supporting said bag in a suspended orientation.

11. The bag of claim 7 further comprising wheel members coupled to at least one of said back and side walls for facilitating transporting of said bag.

12. The bag of claim 7 further comprising suspension members coupled to said panels for supporting said panels in a suspended orientation.

13. An athletic bag for carrying, storing and airing out athletic equipment such as hockey skates, pads and gloves, said bag comprising:

a fabric enclosure member including a rectangularly shaped back wall hingedly secured between first and second rectangularly shaped side walls;

a rigid back panel removably secured to said back wall;

a rigid first side panel removably secured to said first side wall;

a rigid second side panel removably secured to said second side wall;

a plurality of storage members coupled to said panels for stowing said equipment thereon; and a closure mechanism for interconnecting remaining free edges of said back and side walls.

14. The bag of claim 13 further comprising a handle coupled to said enclosure member for carrying said bag.

15. The bag of claim 13 further comprising a hanger coupled to said enclosure member for suspending said bag.

16. The bag of claim 13 further comprising a hanger coupled to each of said panels for hanging said panels independent of said enclosure member.

17. The bag of claim 13 further comprising wheel members coupled to said enclosure member.

18. The bag of claim 13 wherein said closure mechanism interconnects said free edges of said back and side walls via at least one flap having a width corresponding to a width of said back wall such that said enclosure member forms a block shaped bag having an interior volume when in said closed mode.

* * * * *